US006663981B1

(12) United States Patent
Weber et al.

(10) Patent No.: US 6,663,981 B1
(45) Date of Patent: Dec. 16, 2003

(54) MARKER FOR USE IN A MAGNETIC ANTI-THEFT SECURITY SYSTEM AND METHOD FOR MARKING THE MARKER

(75) Inventors: Hartwin Weber, Hanau (DE); Gernot Hausch, Langenselbold (DE); Ottmar Roth, Gründau (DE)

(73) Assignee: Vacuumschmelze GmbH, Hanau (DE)

( * ) Notice: Subject to any disclaimer, the term of this patent is extended or adjusted under 35 U.S.C. 154(b) by 0 days.

(21) Appl. No.: 09/269,490

(22) PCT Filed: Jul. 15, 1998

(86) PCT No.: PCT/DE98/01984

§ 371 (c)(1),
(2), (4) Date: Jun. 8, 1999

(87) PCT Pub. No.: WO99/06977

PCT Pub. Date: Feb. 11, 1999

(30) Foreign Application Priority Data

Jul. 30, 1997 (DE) ..... 197 32 872

(51) Int. Cl.[7] ..... H01F 1/00; G08B 13/24

(52) U.S. Cl. ..... 428/611; 116/204; 148/120; 148/121; 148/309; 148/310; 148/311; 335/296; 340/568.1; 428/636; 428/637; 428/638; 428/686; 428/900; 428/928

(58) Field of Search ..... 428/900, 611, 428/636, 637, 638, 686, 928; 148/100, 120, 121, 122, 309, 310, 311; 420/77, 79, 80, 81, 94, 95, 96, 97, 103, 104, 105, 107, 108, 109, 112, 113, 119, 123, 124; 335/296; 340/568.1; 116/204

(56) References Cited

U.S. PATENT DOCUMENTS

| | | | | |
|---|---|---|---|---|
| 4,743,890 A | | 5/1988 | Hilzinger et al. | |
| 4,945,339 A | | 7/1990 | Yamauchi et al. | |
| 6,157,301 A | * | 12/2000 | Radeloff et al. | 148/310 |
| 6,166,636 A | * | 12/2000 | Herget et al. | 148/310 |

FOREIGN PATENT DOCUMENTS

| | | |
|---|---|---|
| EP | 0 316 811 | 5/1989 |
| EP | 0 121 649 | 8/1995 |
| GB | 2 104 099 | 3/1983 |
| WO | WO 90/03652 | 4/1990 |

* cited by examiner

*Primary Examiner*—Robert R. Koehler
(74) *Attorney, Agent, or Firm*—Schiff Hardin & Waite

(57) ABSTRACT

A marker for use in a magnetic anti-theft security system has an amorphous ferromagnetic alloy alarm strip and at least one activation strip. The semi-hard magnetic alloy for the activation strip contains 8 to 25 weight % Ni, 1.5 to 4.5 weight % Al, 0.5 to 3 weight % Ti and balance of iron.

The alloy is distinguished over known, employed alloys by excellent magnetic properties and a high resistance to corrosion. Further, the alloy can be excellently cold-worked before the annealing.

9 Claims, 4 Drawing Sheets

OPPOSING FIELD STABILITY
DEPENDENT ON COERCIVITY $H_C$
DEMAGNETIZATION
AT 4 A/cm (%)
100
90
80
70
60
50
40
30
20
10
0
MINIMUM
VALUE
0
5
10
15
20
25
30
35
40
45
$H_C$(A/cm)

FIG 2 DEMAGNETIZATION DEPENDENT ON COERCIVITY $H_C$

TENSILE STRESS SENSITIVITY
OF REMANENCE $B_r$
$B_r$(T)
1.70
1.65
1.60
1.55
1.50
1.45
0
30
60
90
120
150
180
210
stress [MPa]
VACOZET 655
FeNiAlTi (KV 85%)
FeNiAlTi (KV 70%)

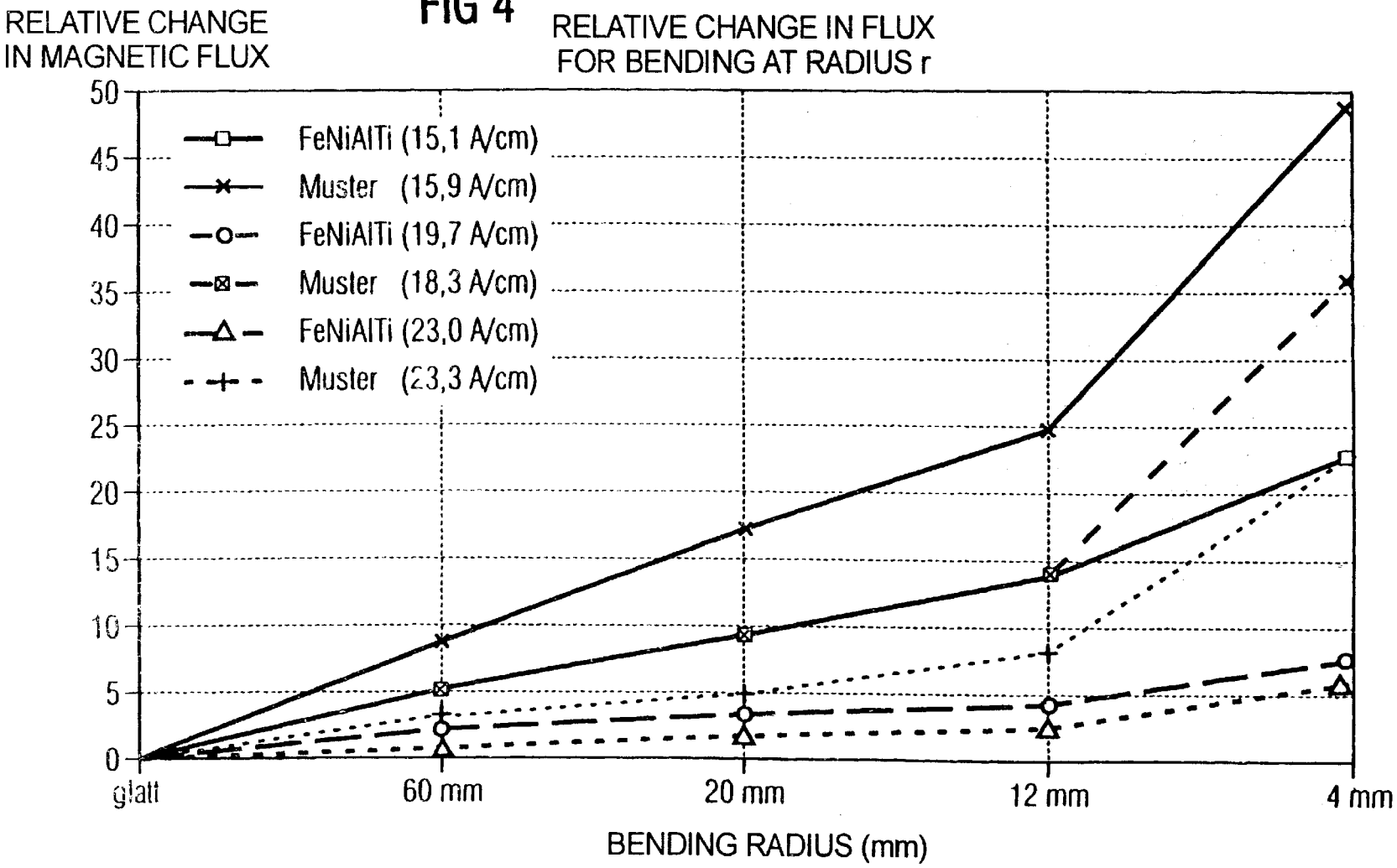
FIG 4 RELATIVE CHANGE IN FLUX FOR BENDING AT RADIUS r

MARKER FOR USE IN A MAGNETIC ANTI-THEFT SECURITY SYSTEM AND METHOD FOR MARKING THE MARKER

BACKGROUND OF THE INVENTION

1. Field of the Invention

The present invention is directed to a marker for use in a magnetic anti-theft security system, the marker being of the type which is composed of an oblong alarm strip composed of an amorphous ferromagnetic alloy, and at least one activation strip composed of a semi-hard magnetic alloy.

2. Description of the Prior Art

Magnetic anti-theft security systems and markers therefor of the above type are well known and are described in detail in, for example, European Application 0 121 649, and PCT Application 90/03652. First, there are magneto-elastic systems wherein the activation strip serves for activation of the alarm strip by magnetizing it; second, there are harmonic systems wherein the activation strip, after being magnetized, serves for the deactivation of the alarm strip.

The alloys with semi-hard magnetic properties that are employed for the pre-magnetization strip include Co—Fe—V alloys, which are known as VICALLOY, Co—Fe—Ni alloys, which are known as VACOZET, as well as Fe—Co—Cr alloys. These known semi-hard magnetic alloys contain high cobalt parts, some at least 45 weight %, and are correspondingly expensive.

In their magnetically finally annealed condition, further, these alloys are brittle, so that they do not exhibit adequate ductility in order to adequately meet the demands given display elements for anti-theft security systems. One important demand, namely, is that these activation strips should be insensitive to bending or deformation.

In the meantime, further, a switch has been made to introducing the markers in anti-theft security systems directly into the product to be secured (source tagging) Such source tagging imposes the additional demand that the semi-hard magnetic alloys should be able to be magnetized from a greater distance or with smaller fields. To satisfy this additional demand, it has been shown that the coercive force $H_c$ must be limited to values of at most 24 A/cm.

On the other hand, however, an adequate opposing field stability is also required which determines the lower limit value of the coercive force. Only coercive forces of at least 10 A/cm are thereby suited.

Further, the remanence should be optimally slight under bending or tensile stress. A change of less than 20% is prescribed as guideline.

SUMMARY OF THE INVENTION

It is an object of the present invention to provide a marker of the above-described type for a magnetic anti-theft system, having an activation strip which satisfies the above demands for source tagging.

This object is inventively achieved in a marker having an activation strip composed of a semi-hard magnetic alloy comprising 8 to 25 weight % nickel, 1.5 to 4.5 weight % aluminum, 0.5 to 3 weight % titanium and the balance iron.

The alloy can further contain 0 to 5 weight % cobalt and/or 0 to 3 weight % molybdenum or chromium and/or at least one of the elements Zr, Hf, V, Nb, Ta, W, Mn, Si in individual parts of less than 0.5 weight % of the alloy and in an overall part of less than 1 weight % of the alloy and/or at least one of the elements C, N, S, P, B, H, O in individual parts of less than 0.2 weight % of the alloy and in an overall part of less than 1 weight % of the alloy.

The alloy is characterized by a coercive strength $H_c$ of 10 to 24 A/cm and a remanence $B_r$ of at least 1.3 T (13,000 Gauss).

The inventive alloys are highly ductile and can be excellently cold-worked before the annealing, so that crossectional reductions of more than 90% are also possible. An activation strip having a thickness of less than 0.05 mm can be manufactured from such alloys, particularly by cold rolling. Further, the inventive alloys are characterized by excellent magnetic properties and resistance to corrosion.

A preferred alloy is a semi-hard magnetic iron alloy according to the present invention that contains 13.0 to 17.0 weight % nickel, 1.8 to 2.8 weight % aluminum as well as 0.5 to 1.5 weight % titanium. By reducing the aluminum content, the magnetostriction can, in particular, be especially favorably set.

Typically, the activation strips are manufactured by melting the alloy under vacuum and casting to form an ingot. Subsequently, the ingot is hot-rolled into a tape at temperatures above 800° C., then intermediately annealed at a temperature above 800° C. and then rapidly cooled. A cold working, expediently cold rolling corresponding to a crossectional reduction of approximately 90% is followed by an intermediate annealing at approximately 700° C. A cold working, expediently cold rolling corresponding to a crossectional reduction of at least 60%, preferably 75% or more subsequently occurs. As last step, the cold-rolled tape is annealed at temperatures from approximately 400° C. to 600°. The activation strips are then cut to length.

DESCRIPTION OF THE DRAWINGS

FIG. 4 illustrates the relative change of the magnetic flux, in percent, at various coercive field strengths after mechanical deformation for an embodiment of an inventive alloy compared to a known alloy of the prior art.

DESCRIPTION OF THE PREFERRED EMBODIMENTS

The following demands derive for the suitability of an alloy for an activation strip in an anti-theft security system, particularly for a system employing source tagging:

The change of the remanence under bending or tensile stress should be optimally slight. A change of less than 20% is prescribed as guideline. As can be seen from FIG. 3, values $\leqq$10% are achieved with the alloys of the present invention.

It can be seen from FIG. 4 that, in addition to being determined by the alloy, the coercive field strength and the bending radius also determine the change of the flux. Given corresponding coercive field strengths, the alloys according to the present invention achieve values <5% given bending radii $\geqq$12 mm or, respectively, values <10% given bending radii $\geqq$4 mm and thicknesses of approximately 50 $\mu$m.

Figure 3:
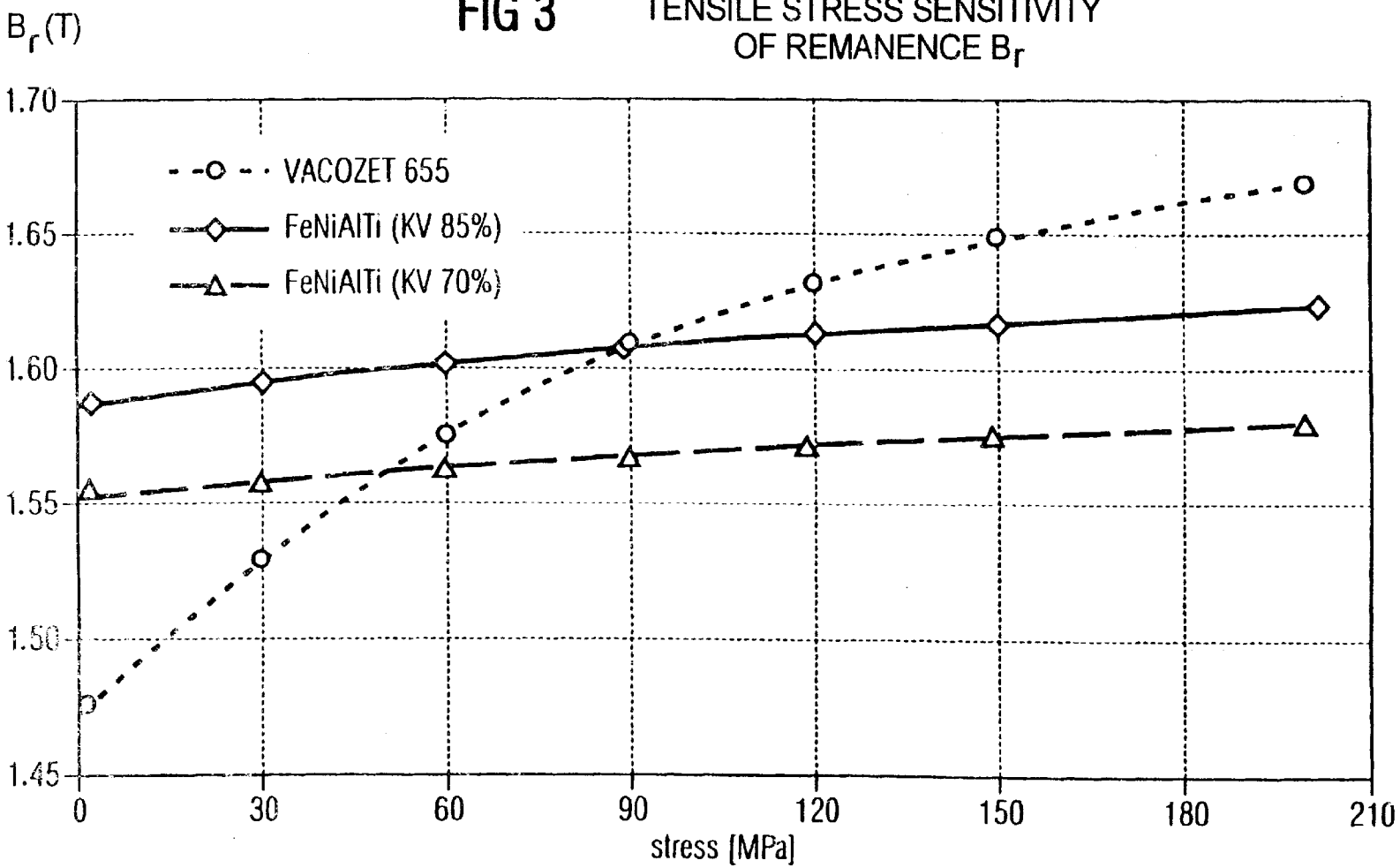
FIG. 3 illustrates the change of the remanence under tensile stress of two embodiments of an inventive alloy, compared to a known alloy of the prior art.

The relationship of the saturation at a given, slight magnetizing field strength of, for example, 40 A/cm to the saturation $B_f$ given a magnetic field in the kOe range should be nearly 1, which can be seen from FIG. 3.

The opposing field stability should be of such a nature that the remanence $B_S$ still retains at least 80% of its original value after an opposing field magnetization of a few A/cm.

Finally, the remanence should retain only 20% of the original value after a demagnetization cycle with a predetermined magnetic field.

In detail, this means that a magnetization of the activation strip, i.e. an activation/deactivation of the display element, can also ensue on site. However, only very small fields are generally available there. The saturation that is achieved should differ only slightly from the value given high magnetizing fields in order to guarantee identical behavior of the display elements.

Figure 1:
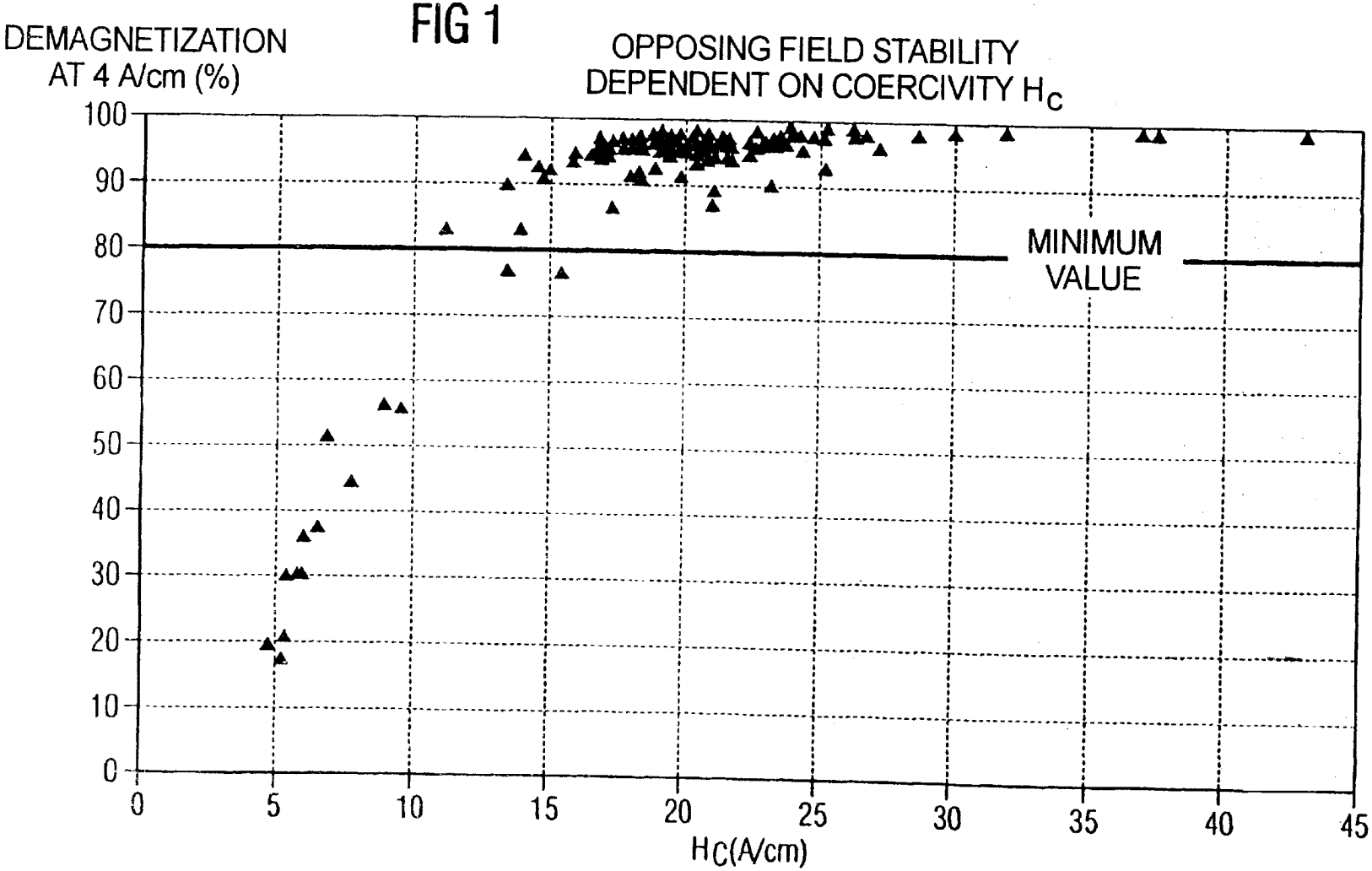
FIG. 1 illustrates the demagnetization behavior of inventive Fe—Ni—Al—Ti alloys after an alternating field magnetization at 4 A/cm, dependent on the coercive force.

The display elements must be of such a nature that their remanence $B_r$ changes only slightly in the proximity of the coils in the detection locks as a consequence of a field that is elevated thereat and is potentially oriented in the opposite direction. As can be seen from FIG. 1, the inventive alloys exhibit an opposing field stability as demanded.

Figure 2:
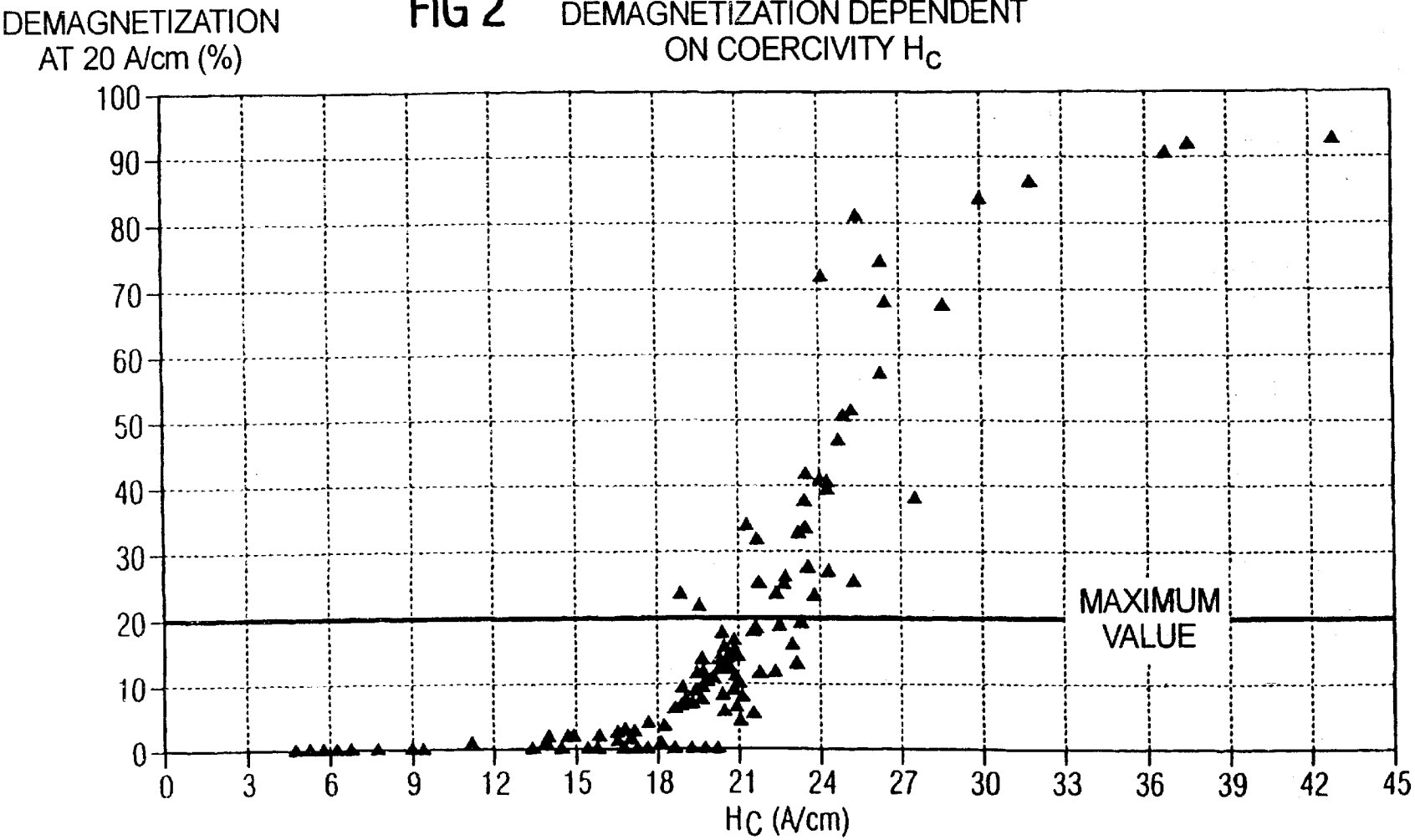
FIG. 2 illustrates the demagnetization behavior of inventive Fe—Ni—Al—Ti alloys after an alternating field magnetization at 20 A/cm, dependent on the coercive force.

Finally, the display elements must be capable of being demagnetized with relatively small fields, i.e. deactivated given magneto-elastic display elements or, respectively, activated given harmonic display elements. FIG. 2 illustrates these relationships given the inventive alloys.

Simultaneously meeting these last three demands yields extremely great limitations for the accessible ranges of the coercive forces $H_c$ since the three demands are contradictory.

The alloys of the present invention are typically manufactured by casting a melt of the alloy constituents in a crucible or furnace under vacuum or a protective gas atmosphere. The temperatures thereby lie at approximately 1600° C.

The casting typically ensues into a round ingot mold. The cast ingots of the present alloys are then typically processed by hot working, intermediate annealing, cold working and further intermediate annealing. The intermediate annealing ensues for the purpose of homogenization, grain sophistication, shaping or the creation of desirable mechanical properties, particularly a high ductility.

An excellent structure is achieved, for example, by the following processing:

Thermal treatment at, preferably, temperatures above 800° C., rapid cooling and annealing. Preferred annealing temperatures lie at 400° C. through 600° C., and the annealing times typically lie advantageously one minute through 24 hours. A cold working corresponding to a crossectional reduction of at least 60% before the annealing is, in particular, possible with the inventive alloys.

The coercive force and the rectangularity of the magnetic B-H loop are enhanced by the step of annealing, this being important for the demands made of activation strips.

The manufacturing method for especially good activation strips comprises the following steps:

1. Casting at 1600° C.
2. Hot rolling of the ingot at temperature above 800° C.
3. Multi-hour intermediate annealing at above 800° C. with quenching in water.
4. Cold rolling corresponding to a crossectional reduction of approximately 90%.
5. Cold working corresponding to a crossectional reduction of approximately 90%.
6. Intermediate annealing at approximately 700° C.
7. Multi-hour intermediate annealing at approximately 700° C.
8. Cold working corresponding to a crossectional reduction of approximately 70%.
9. Multi-hour annealing at approximately 480° C.
10. Cutting and trimming the activation strips.

Activation strips that exhibited an excellent coercive force $H_c$ and a very good remanence $B_r$ were manufactured with this method. The magnetization properties and the opposing field stability were excellent.

The manufacture of several embodiments of Fe—Ni—Al—Ti activation strips in accordance with the invention is described in detail on the basis of the following examples:

EXAMPLE 1

An alloy with 18.0 weight % nickel, 3.8 weight % aluminum, 1.0 weight % titanium and the balance iron was melted under vacuum. The resulting ingot was hot-rolled at approximately 1000° C., intermediately annealed for one hour at 1100° C. and rapidly cooled on water. After a subsequent cold-rolling with a crossectional reduction of 80%, the resulting ribbon was again intermediately annealed for one hour at 1100° C. and rapidly cooled in water. After a further cold working with a crossectional reduction of 50%, the ribbon was intermediately annealed for four hours at 650° C. Corresponding to a crossectional reduction of 90%, the ribbon was subsequently cold-rolled and annealed at 520° C. for three hours and cooled in air. A coercive force $H_c$ equal to 23 A/cm as well as a remanence $B_r$ equal to 1.48 T were measured.

EXAMPLE 2

An alloy with 15.0 weight % nickel, 3.0 weight % aluminum, 1.2 weight % titanium and balance iron was processed as in Example 1 but with a last intermediate annealing at 700° C., a last cold working corresponding to a crossectional reduction of 70% as well as a final annealing at 500° C. A coercive force $H_c$ equal to 21 A/cm and a remanence $B_r$ equal to 1.45 T were measured.

EXAMPLE 3

An alloy with 15.0 weight % nickel, 3.0 weight % aluminum, 1.2 weight % titanium and balance iron was manufactured as in Example 2. Deviating therefrom, the last intermediate annealing ensued at 650° C., the last cold working corresponding to a crossectional reduction of 85% and the annealing treatment at 480° C. A coercive force $H_c$ equal to 20 A/cm and a remanence $B_r$ equal to 1.53 T were measured.

EXAMPLE 4

An alloy with 15.0 weight % nickel, 3.0 weight % aluminum, 1.2 weight % titanium, 2.0 weight % molybdenum and balance iron was manufactured as in Example 2. After an annealing treatment at 480° C., a coercive force $H_c$ equal to 20 A/cm and a remanence $B_r$ equal to 1.56 T were measured.

EXAMPLE 5

An alloy with 15.0 weight % nickel, 2.0 weight % aluminum, 0.8 weight % titanium and balance iron was melted under vacuum. The resulting ingot was hot-rolled at approximately 1000° C., intermediately annealed at 900° C. for one hour and rapidly cooled in water. After a following cold-rolling with a crossectional reduction of 90%, the resulting ribbon was intermediately annealed for four hours at 650° C. Corresponding to a crossectional reduction of 95%, the ribbon was subsequently cold-rolled and annealed for three hours at 460° C. and air-cooled. A coercive force $H_c$ equal to 14 A/cm and a remanence $B_r$ equal to 1.46 T were measured.

EXAMPLE 6

An alloy with 15.0 weight % nickel, 2.5 weight % aluminum, 1.2 weight % titanium and balance iron was manufactured as in Example 5 but with a crossectional reduction of 83% and an annealing treatment at 420° C. A coercive force $H_c$ equal to 17 A/cm and a remanence $B_r$ equal to 1.44 T were measured.

A satisfactory magnetization behavior and a usable opposing field stability derived in all exemplary embodiments.

Although modifications and changes may be suggested by those skilled in the art, it is the intention of the inventors to embody within the patent warranted hereon all changes and modifications as reasonably and properly come within the scope of their contribution to the art.

What is claimed is:

1. A method for manufacturing an activation strip for a magnetic anti-theft security system, comprising the steps of:

providing an alloy having a composition 8 to 25 wt % Ni, 1.5 to 4.5 wt % Al, 0.5 to 3 wt % Ti, and a remainder of iron;

melting said alloy in an environment selected from the group consisting of a vacuum and a protective atmosphere to obtain a melted alloy, and casting said melted alloy into an ingot;

hot working said ingot to form a ribbon at a temperature above approximately 800° C.;

annealing said ribbon at a temperature above approximately 800° C.;

rapidly cooling said ribbon to produce a cooled ribbon having a cross-section;

cold-working said cooled ribbon and thereby reducing the cross-section thereof by approximately 90%, to obtain a cold-worked ribbon;

annealing said cold-worked ribbon in a range between approximately 650° and 700° C. to obtain a cold-worked and annealed ribbon having a cross-section;

cold-working said cold-worked and intermediately annealed ribbon to reduce the cross-section thereof by at least 60% to obtain a twice cold-worked ribbon;

annealing said twice cold-worked ribbon at a temperature in a range between approximately 400° and 600° to obtain a finished ribbon; and cutting and trimming said finished ribbon into a plurality of activation strips, said activation strips having a coercive force $H_c$ between and 10 and 24 A/cm and a remanence $B_r$ of at least 1.3 T.

2. A marker for magnetic anti-theft security system, comprising:

an oblong alarm strip of an amorphous ferromagnetic alloy;

at least one activation strip of a semi-hard magnetic alloy;

said semi-hard magnetic alloy comprising:

8 to 25 wt % Ni, 1.5 to 4.5 wt % Al, 0.5 to 3 wt % Ti;

a remainder of iron; and said semi-hard magnetic alloy having a coercive force $H_c$ between 10 and 24 A/cm and a remanence $B_r$ of at least 1.3 T.

3. A marker as claimed in claim 2 wherein said semi-hard magnetic alloy further comprises at least one constituent selected from less than 5 wt % Co, and less than 3 wt % Mo or Cr.

4. A marker as claimed in claim 2 wherein said semi-hard magnetic alloy further comprises at least one element selected from the group consisting of Zr, Hf, Nb, Ta, Mn and Si, wherein each selected element is less than 0.5 wt % of the alloy and all selected elements in total are less than 1 wt % of the alloy.

5. A marker as claimed in claim 2 wherein said semi-hard magnetic alloy further comprises at least one element selected from the group of elements consisting of C, N, S, P, B, H, and O, wherein each selected element is less than 0.2 wt % of the alloy and all selected elements in total are less than 1 wt % of the alloy.

6. A marker as claimed in claim 2 wherein said semi-hard magnetic alloy further comprises at least one constituent selected from less than 5 wt % of Co, and less than 3 wt % Mo or Cr, and at least one element selected from the group consisting of Zr, Hf, Ta, Nb, Mn and Si, wherein each selected element is less than 0.5 wt % of the alloy and all selected elements in total are less than 1 wt % of the alloy.

7. A marker as claimed in claim 2 wherein said semi-hard magnetic alloy further comprises at least one constituent selected from less than 5 wt % of Co, and less than 3 wt % Mo or Cr, and at least one element selected from the group consisting of C, N, S, P, B, H, and O, wherein each selected element is less than 0.2 wt % of the alloy and all selected elements in total are less than 1 wt % of the alloy.

8. A marker as claimed in claim 2 wherein said semi-hard magnetic alloy further comprises at least one constituent selected from the group consisting of Zr, Hf, Ta, Nb, Mn and Si, wherein each selected element is less than 0.5 wt % of the alloy and all selected elements in total are less than 1 wt % of the alloy; and at least one element selected from the group consisting of C, N, S, P, B, H, and O, wherein each selected element is less than 0.2 wt % of the alloy and all selected elements in total are less than 1 wt % of the alloy.

9. A marker as claimed in claim 2 wherein said semi-hard magnetic alloy further comprises at least one constituent selected from less than 5 wt % of Co, and less than 3 wt % Mo or Cr;

at least one element selected from the group consisting of Zr, Hf, Ta, Nb, Mn and Si, wherein each selected element is less than 0.5 wt % of the alloy and all selected elements in total are less than 1 wt % of the alloy; and at least one element selected from the group consisting of C, N, S, P, B, H, and O, wherein each selected element is less than 0.2 wt % of the alloy and all selected elements in total are less than 1 wt % of the alloy.

* * * * *